US006142089A

United States Patent [19]

Harada et al.

[11] Patent Number: 6,142,089

[45] Date of Patent: Nov. 7, 2000

[54] SEWING MACHINE WITH IMPROVED SHUTTLE DRIVE CONTROL

[75] Inventors: Koichi Harada, Koichi; Koichi Akahane, Nagoya; Motonari Nakano, Ichinomiya; Yoshihisa Nozaki, Hoi-gun, all of Japan

[73] Assignee: Brother Kogyo Kabushiki Kaisha, Nagoya, Japan

[21] Appl. No.: 09/027,460

[22] Filed: Feb. 23, 1998

[30] Foreign Application Priority Data

Mar. 19, 1997 [JP] Japan ..... 9-085727

[51] Int. Cl.[7] ..... D05B 19/12; D05B 57/30; D05B 69/18

[52] U.S. Cl. ..... 112/470.02; 112/155; 112/220; 112/278; 112/102.5; 364/470.09

[58] Field of Search ..... 112/470.01, 470.02, 112/470.06, 102.5, 220, 221, 155, 181, 201, 273, 278, 275; 364/470.09, 470.07

[56] References Cited

U.S. PATENT DOCUMENTS 5,718,183 2/1998 Shimizu et al. ..... 112/275
5,832,851 11/1998 Kato ..... 112/470.01
5,860,377 1/1999 Akahane et al. ..... 112/470.01

FOREIGN PATENT DOCUMENTS 60-21750 5/1985 Japan .
3-234291 10/1991 Japan .

*Primary Examiner*—Peter Nerbun
*Attorney, Agent, or Firm*—Oliff & Berridge, PLC

[57] ABSTRACT

A sewing machine includes a sewing machine motor, a main shaft driven by the sewing machine motor, a sewing needle driven by the main shaft, a shuttle for capturing a thread loop in cooperation with the sewing needle, the shuttle having a hook shaft, a shuttle driving motor for driving the hook shaft of the shuttle independent of the sewing machine motor, a drive control device for controlling the sewing machine motor and shuttle driving motor so that the shuttle is rotated in synchronism with the main shaft, a thread jamming detecting device for detecting a thread jamming in the shuttle, and a releasing device for controlling the shuttle driving motor so that the shuttle is released from the thread jamming, when the thread jamming is detected by the thread jamming detecting device.

14 Claims, 10 Drawing Sheets

SEWING MACHINE WITH IMPROVED SHUTTLE DRIVE CONTROL

BACKGROUND OF THE INVENTION

1. Field of the invention

This invention relates to a sewing machine including a sewing machine motor for driving a main shaft and a shuttle driving motor for driving a thread loop capturing shuttle independent of the sewing machine.

2. Description of the related art

There have conventionally been provided vertical axis drive type sewing machines comprising a single sewing machine motor for driving both a main shaft for vertically driving sewing needles and thread take-up levers, and a lower shaft for driving thread loop capturing shuttles such as full-turn shuttles. On the other hand, Japanese patent publication Nos. 60-21750-B and 3-234291-A each disclose a hook shaft independent drive type sewing machine comprising an independent shuttle driving motor for driving a thread loop capturing shuttle as well as a sewing machine motor for driving a main shaft. In the independent hook shaft drive type sewing machines, the sewing machine motor and the shuttle driving motor are controlled so that the shuttle is driven in synchronism with the main shaft of the machine. Furthermore, the shuttle is controlled to be driven according to various sewing conditions.

For example, in embroidery sewing machines, a leading end of needle thread is usually open when a sequence of sewing operations is started or when the sewing operation is re-started after a thread of one color has been changed to a thread of another color during the sewing operation. Accordingly, a thread loop captured by a beak of a rotating hook is often loosened immediately after start or re-start of the sewing operation. In such a case, the loosened thread loop is sometimes caught between the rotating hook and an annular rib or race which is formed on an outer periphery of a rotating hook bobbin case holder to prevent fall-off of the holder from the rotating hook. This is referred to as "thread jamming." A generally small-sized motor is used as the shuttle driving motor and has a small torque in the independent shuttle drive type sewing machines. As a result, the shuttle and the needle are desynchronized relative to each other or the full-turn shuttle is abruptly stopped at one rotational position. Accordingly, in order that the needle in a downward movement may be prevented from colliding against the shuttle, the sewing machine motor is stopped upon detection of loss-of-synchronism of the shuttle, so that the sewing is interrupted. Upon stop of the sewing machine motor, an operator opens a protecting cover of the full-turn shuttle to find the thread jamming. Then, the operator manually reverses the full-turn shuttle to eliminate the thread jamming. Thereafter, a reset switch is operated so that the sewing machine is released from an error mode and so that the main shaft and the full-turn shuttle are initialized so as to return to the respective rotational positions for the start of the sewing. The sewing can be re-started upon operation of the sewing start key in the initialized state.

Thus, in the above-described independent hook shaft drive type sewing machines as disclosed in Japanese patent publication Nos. 60-21750-B and 3-234291-A, the elimination of the thread jamming in use of the full-turn shuttle requires the reverse rotation of the shuttle, operation of the reset switch, and operation of the sewing start key so that the sewing is re-started. The operation for the elimination of thread jamming and restart of the sewing is complicated in the independent hook shaft drive type sewing machines.

Furthermore, it takes much time until the thread jamming is eliminated and the sewing is re-started. Since the sewing machine is stopped for a long time, the sewing efficiency is reduced.

SUMMARY OF THE INVENTION

Therefore, an object of the present invention is to provide a sewing machine wherein thread jamming occurring in the thread loop capturing shuttle can readily be eliminated in its early stage so that a stop time of the machine can be shortened as much as possible.

The present invention provides a sewing machine comprising a sewing machine motor, a main shaft driven by the sewing machine motor, a sewing needle driven by the main shaft, a shuttle for capturing a thread loop in cooperation with the sewing needle, the shuttle having a hook shaft, a shuttle driving motor provided for driving the hook shaft of the shuttle independent of the sewing machine motor, drive control means for controlling the sewing machine motor and the shuttle driving motor so that the shuttle is rotated in synchronism with the main shaft, thread jamming detecting means for detecting a thread jamming in the shuttle, and releasing means controlling the shuttle driving motor for releasing the shuttle from the thread jamming when the thread jamming is detected by the thread jamming detecting means.

According to the above-described sewing machine, the sewing machine motor and the shuttle driving motor are desynchronized relative to each other or the shuttle driving motor is stopped when a thread jamming occurs in the shuttle. In this case, however, the thread jamming is detected by the thread jamming detecting means, and the shuttle is released from the thread jamming by the releasing means. Consequently, the thread jamming can be eliminated from the shuttle automatically and readily.

The invention also provides a sewing machine comprising a sewing machine motor, a main shaft driven by the sewing machine motor, a sewing needle driven by the main shaft, a shuttle for capturing a thread loop in cooperation with the sewing needle, the shuttle having a hook shaft, a shuttle driving motor provided for driving the hook shaft of the shuttle independent of the sewing machine motor, drive control means for controlling the sewing machine motor and the shuttle driving motor so that the shuttle is rotated in synchronism with the main shaft, loss-of-synchronism detecting means for detecting an increase to a predetermined amount in displacement of a rotational position of the hook shaft with respect to a rotational position of the main shaft, and hook shaft reverse rotation control means for controlling the shuttle driving motor so that the shuttle driving motor is reverse-rotated by a predetermined amount after interruption thereof when the predetermined amount of displacement has been detected by the loss-of-synchronism detecting means.

In the above-described sewing machine, too, the sewing machine motor and the shuttle driving motor are desynchronized or the shuttle driving motor is stopped when the thread jamming occurs in the shuttle. In this case, however, the loss-of-synchronism detecting means detects the increase to the predetermined amount in the displacement of the rotational position of the hook shaft with respect to the rotational position of the main shaft. The hook shaft reverse rotation control means then reverses the rotation of the shuttle driving motor after the interruption of the shuttle driving motor. Consequently, the thread jamming can also be eliminated from the shuttle automatically and readily.

Each of the above-described sewing machines preferably further comprises main shaft original position detecting means for detecting a predetermined original position of the main shaft for start of the sewing, thereby delivering a first original position signal, hook shaft original position detecting means for detecting an original position of the hook shaft corresponding to the original position of the main shaft, thereby delivering a second original position signal, and initialization control means for controlling the sewing machine motor and the shuttle driving motor so that the main shaft and the hook shaft are positioned at the original positions in case of start of a sewing operation on the basis of the first and second original position signals delivered by the main shaft and hook shaft original position detecting means respectively. In this arrangement, the main shaft and the hook shaft can automatically be initialized so that the sewing is started.

Furthermore, each sewing machine preferably further comprises sewing motion counting means for counting the number of sewing motions of the vertically moved sewing needle from start of a sewing operation in which a series of stitches are formed, and initialization instructing means for instructing the initialization control means to initialize the sewing machine motor and the shuttle driving motor in a case where the number of sewing motions counted by the sewing motion counting means is at or below a predetermined value when the shuttle driving motor has been driven by the releasing means so that the shuttle is released from the thread jamming. Additionally, each sewing machine preferably further comprises mode setting means for setting a re-sewing mode in which the sewing is re-executed from a first stitch, when the initialization instructing means instructs the initialization control means to initialize the sewing machine motor and the shuttle driving motor.

BRIEF DESCRIPTION OF THE DRAWINGS

Other objects, features and advantages of the present invention will become clear upon reviewing the following description of a preferred embodiment thereof, made with reference to the accompanying drawings, in which.

DETAILED DESCRIPTION OF THE PREFERRED EMBODIMENT

One embodiment will be described with reference to the accompanying drawings. The invention is applied to a multi-head embroidery sewing machine in the embodiment. The multi-head embroidery sewing machine comprises three multi-needle embroidery sewing machine units, for example. In each multi-needle embroidery sewing machine, a full-turn shuttle serving as a thread loop capturing shuttle is driven by a shuttle driving motor independent of a sewing machine motor.

Figure 1:
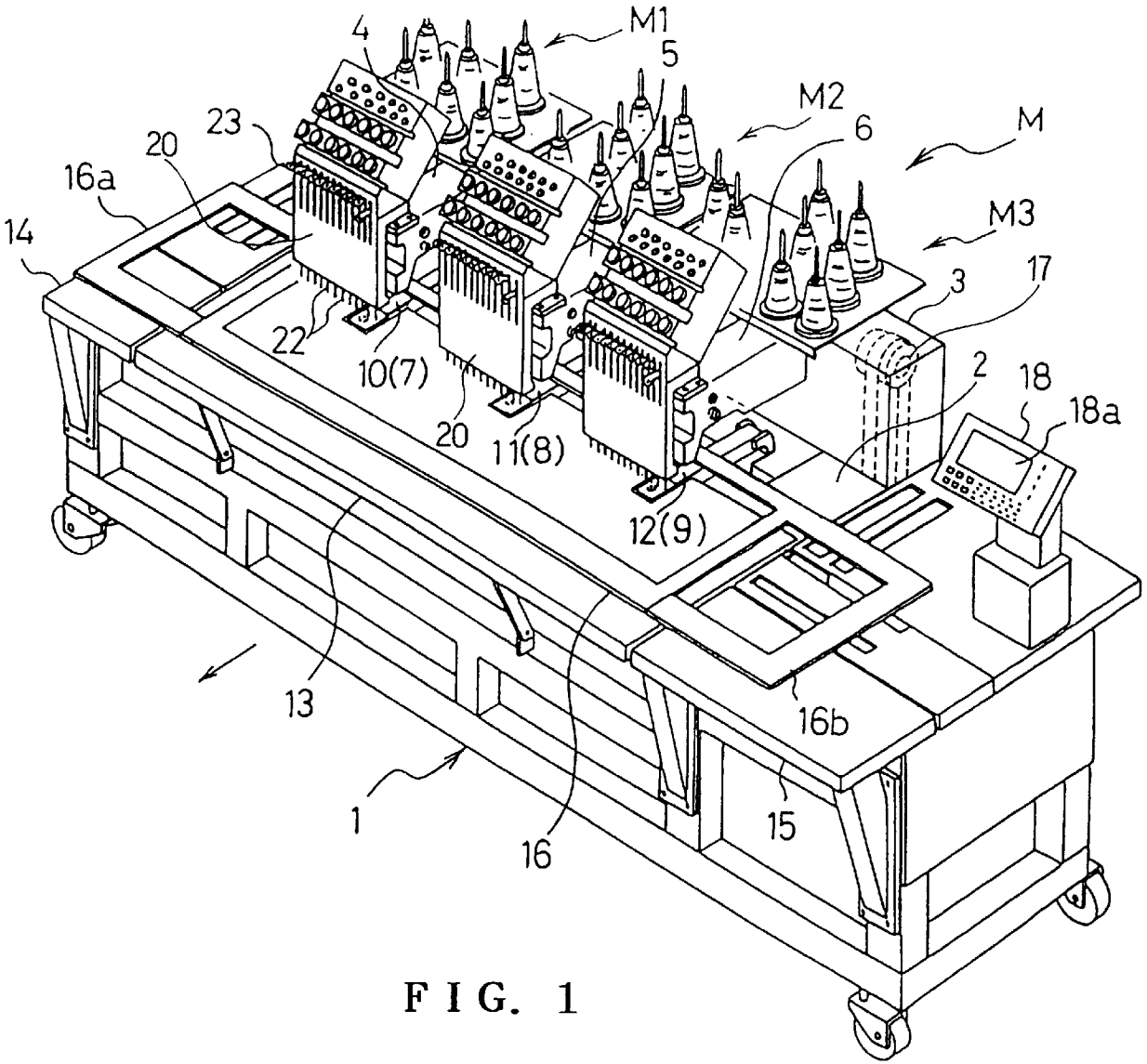
FIG. 1 is a perspective view of a multi-head embroidery sewing machine of one embodiment in accordance with the present invention.
Figure 2:
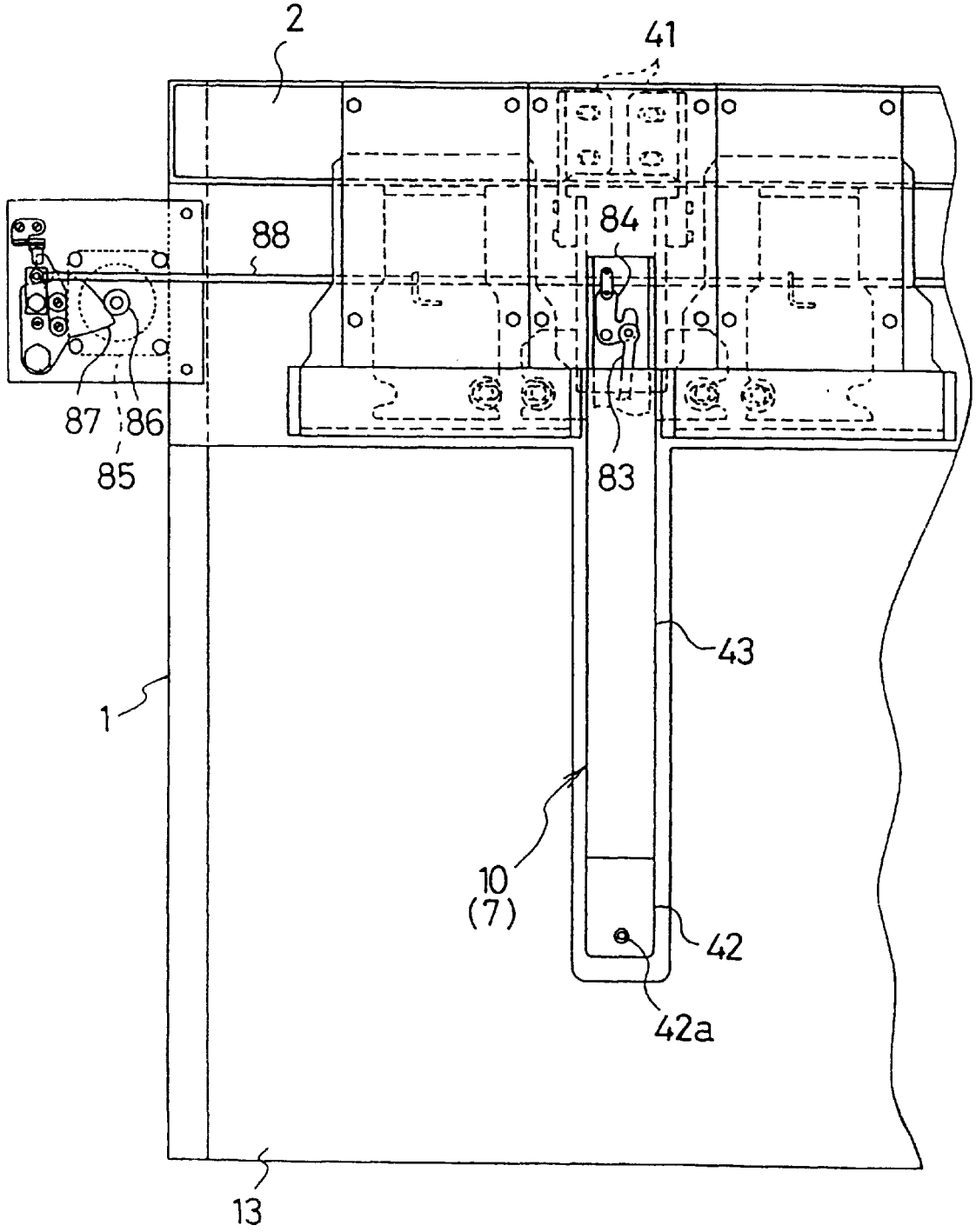
FIG. 2 is a partial plan view showing a working table and one of a plurality of bed units of the multi-head sewing machine.

The multi-head embroidery sewing machine M will first be described. The multi-head embroidery sewing machine M comprises an elongated base frame 1 extending laterally as viewed in FIG. 1. A generally rectangular machine support plate 2 is provided at an upper rear of the base frame 1. A laterally extending support frame 3 stands from a rear end of the machine support plate 2. Three heads 4 to 6 are disposed on the support frame 3 at predetermined intervals. Three generally cylindrical sewing beds 7 to 9 have rear ends mounted on a portion of the base frame 1 located at a front end of the machine support plate 2 so as to correspond to the heads 4 to 6, respectively. The sewing beds 7 to 9 constitute independent bed units 10 to 12 respectively.

The heads 4 to 6 disposed on the support frame 3 and the independent bed units 10 to 12 constitute three multineedle embroidery sewing machine units M1, M2 and M3 respectively. The multineedle sewing machine units M1 to M3 are disposed on the base frame 1 to be arranged along the length thereof. Three needle bar cases 20 are provided on front ends of the heads 4 to 6 to be movable in a transverse direction or rightward and leftward, respectively. In each needle bar case 20, twelve needle bars (not shown) are vertically movably mounted and twelve thread take-up levers 23 are rockably mounted. The needle bars are arranged in the transverse direction and have lower ends to which sewing needles 22 are attached respectively. The needle bar cases 20 are linked to one another so as to be moved rightward and leftward by a needle bar changing mechanism (not shown) driven by a needle bar changing motor 115 (see FIG. 8). Consequently, embroidery threads of one color can simultaneously be changed to those of another color in the three embroidery sewing machine units M1 to M3. The front end of each of the heads 4 to 6 is further provided with a needle bar vertically moving mechanism (not shown) driven by a main shaft 17 further driven by a sewing machine motor 117 (see FIG. 8) for vertically moving the needle bars, a presser foot vertically moving mechanism (not shown) for vertically moving a presser foot (not shown) during movement of a workpiece cloth, and a needle bar jumping mechanism (not shown) for jumping the needle bars up to their uppermost positions. In the embodiment, the needle bar vertically moving mechanisms of the three heads 4 to 6 and accordingly the needle bars and the sewing needles 22 are driven by the single main shaft 17 further driven by a single sewing machine motor 110.

A working table 13 is horizontally provided in front of the machine support plate 2 so as to be substantially planar with the upper faces of the bed units 10 to 12. Two auxiliary tables 14 and 15 are provided at the left-hand and right-hand sides of the working table 13. An elongated rectangular moving frame 16 is disposed to extend over the working and auxiliary tables 13, 14 and 15. The moving frame 16 includes a left-hand end drive frame portion 16*a* moved in the directions of Y-axis or forward and backward by a Y-axis drive mechanism (not shown) and a right-hand end drive frame portion 16*a* moved in the directions of X-axis or leftward and rightward by an X-axis drive mechanism (not shown) and in the directions of Y-axis by the Y-axis drive mechanism. The moving frame 16 is thus moved in the directions of X-axis and Y-axis by the X-axis and Y-axis drive mechanisms in the directions of X-axis and Y-axis or on an X-Y plane. The X-axis and Y-axis drive mechanisms are driven by X-axis and Y-axis drive motors 117 and 119 (see FIG. 8) respectively.

An operation panel 18 is provided in the rear of the auxiliary table 15. The operation panel 18 includes a display 18*a* for displaying messages concerning the embroidery sewing etc. and various operation switches including a sewing start switch and a re-sewing mode setting switch for setting a re-sewing mode for executing re-sewing from a first stitch after occurrence of thread jamming. The re-sewing mode setting switch constitutes mode setting means in the invention.

The bed units 10 to 12 will now be described with reference to FIGS. 2 to 5. Since the three bed units 10 to 12 have the same construction, the only left-hand end bed nit 10 will be described. The bed unit 10 includes a bed case 40 having a generally U-shaped section and extending widthwise with respect to the base frame 1. A rear end of the bed case 40 is mounted to a pair of support brackets 41 secured to the base frame 1 and located at the front end of the machine support plate 2. A shuttle module 50 is detachably attached to a front end of the bed case 40. A forward top of the bed case 40 is covered with a throat plate 42 having a pinhole 42*a* . The other portion of the bed case 40 is covered with a cover plate 43 extending rearward continuously from the throat plate 42.

Figure 3:
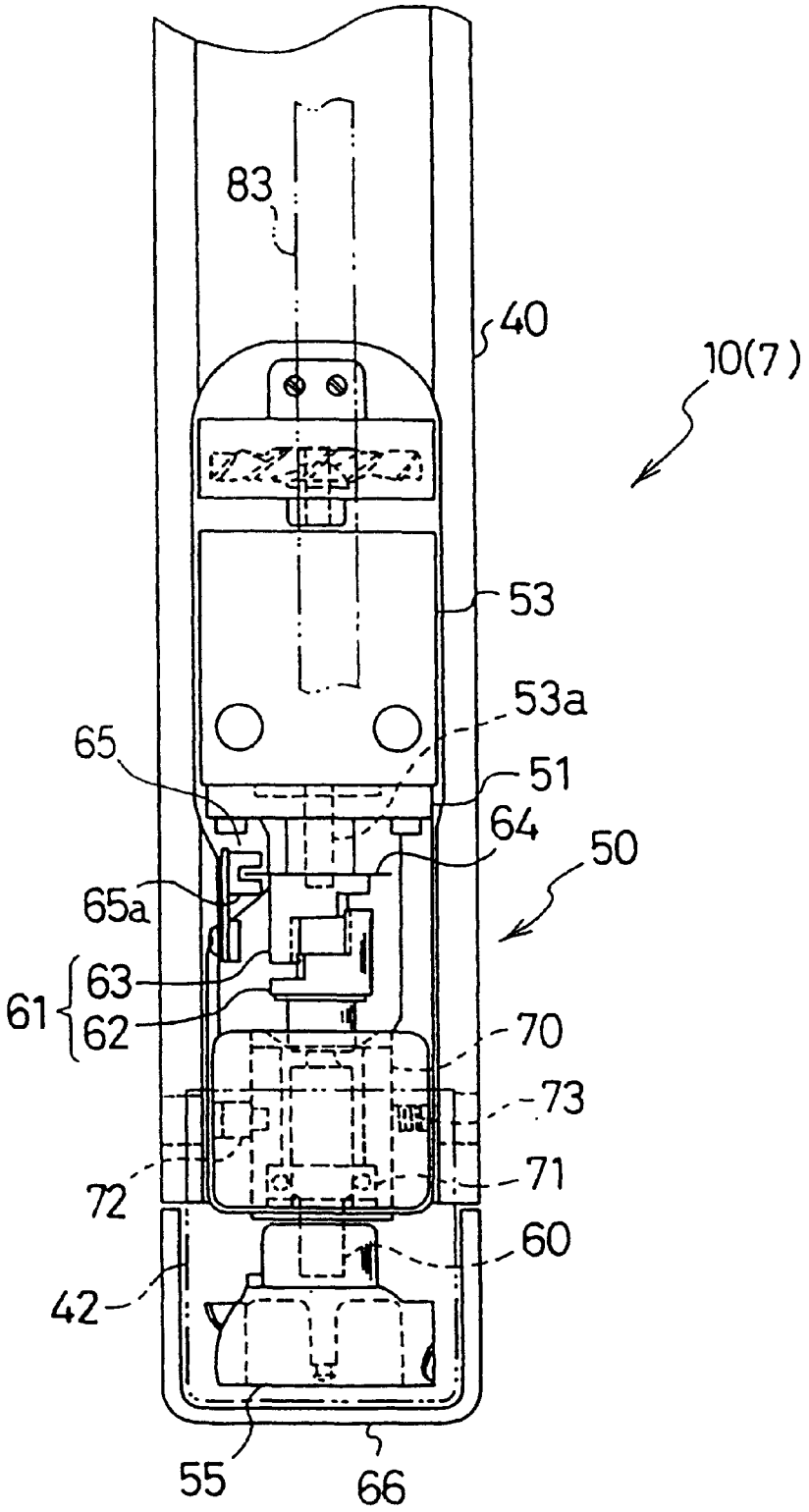
FIG. 3 is a partial plan view of the bed unit provided with a shuttle module.
Figure 4:
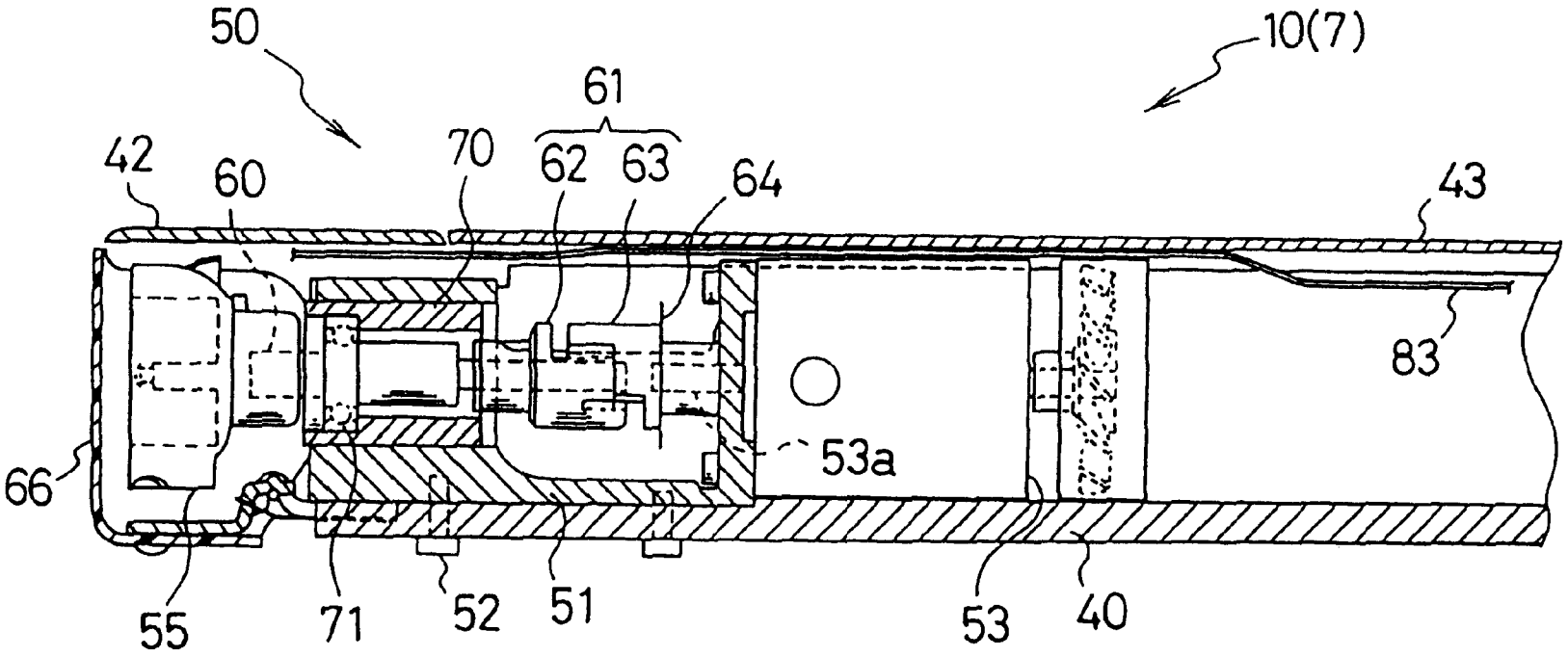
FIG. 4 is a partial longitudinal section of the bed unit provided with the shuttle module.

The shuttle module 50 will then be described. Referring to FIGS. 3 and 4, a mounting block 51 is detachably mounted by small screws 52 on the front end of the bed case 40. A shuttle driving motor 53 comprising, for example, a pulse motor is provided in the rear of the mounting block 51. For example, a full-turn shuttle 55 for capturing a thread loop is provided in front of the mounting block 51. A hook shaft 60 secured to the shuttle 55 is mounted on the mounting block 51 for rotation and for forward and rearward positional adjustment. A first connecting member 62 mounted to a rear end of the hook shaft 60 and a second connecting member 63 mounted to a forward end of a rotational shaft 53*a* of the shuttle driving motor 53 are connected to each other. The hook shaft 60 and the drive shaft 53*a* are connected together via a coupling 61 comprising the two connecting members 62 and 63. Upon drive of the shuttle driving motor 53, the hook shaft 60 is rotated via the drive shaft 53*a* and the coupling 61 so that the full-turn shuttle 55 is rotated. The shuttle 55 is rotated in a preselected direction in synchronism with the sewing machine motor 110 at a rotational speed twice as high as the main shaft 17 or the sewing machine motor.

Figure 6:
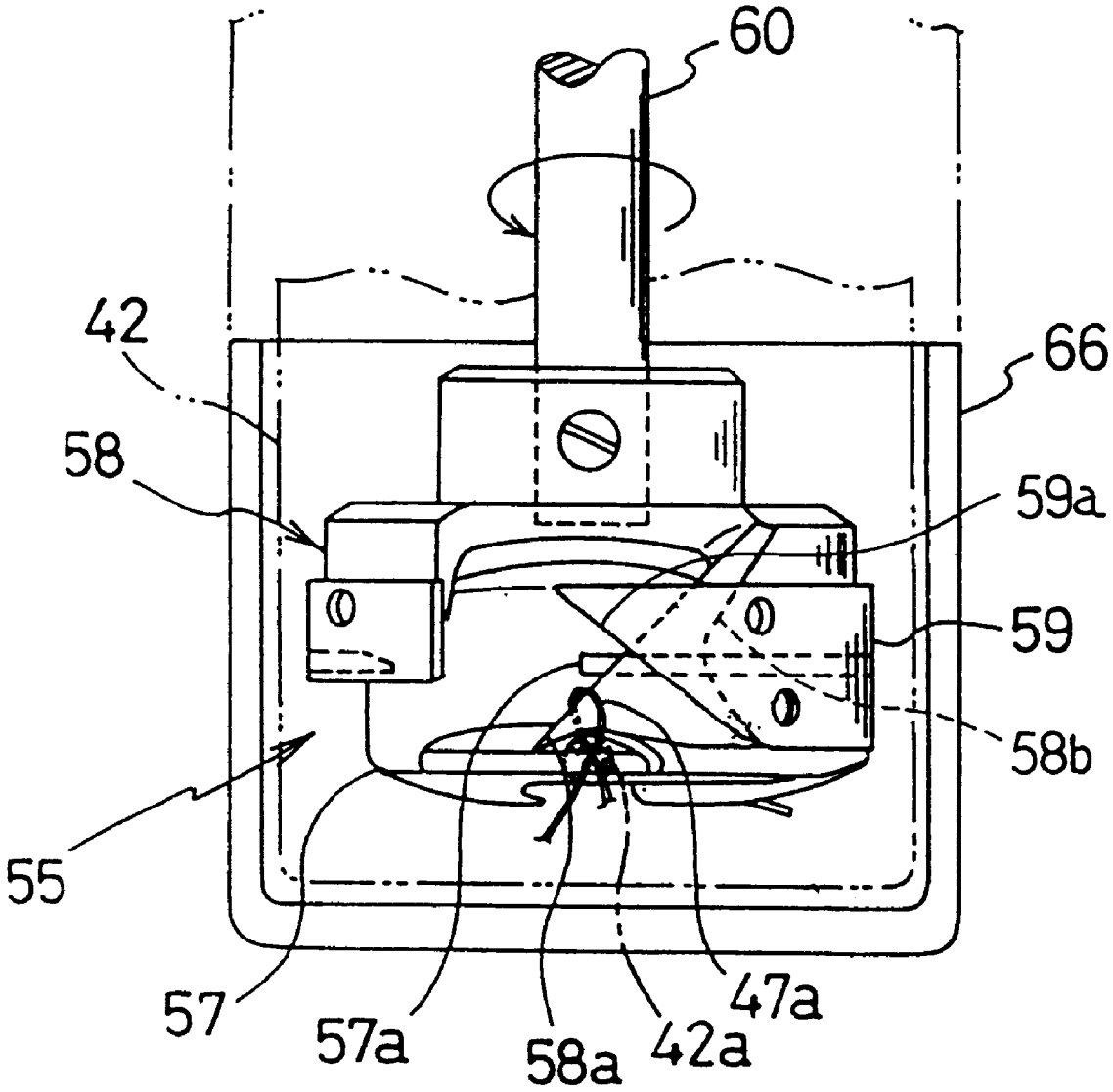
FIG. 6 is an enlarged plan view of a full-turn shuttle.
Figure 7:
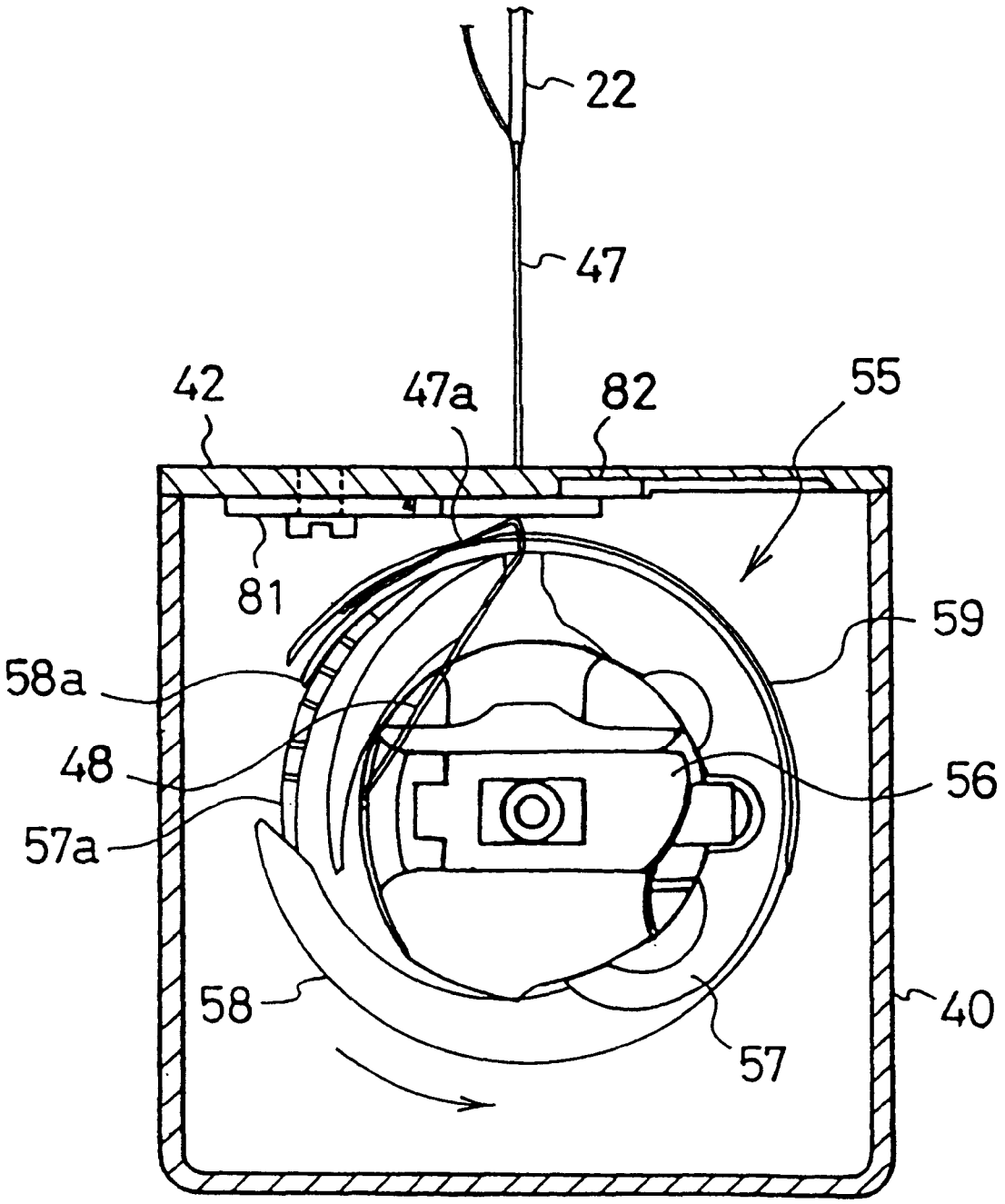
FIG. 7 is a front view of the full-turn shuttle.

The full-turn shuttle 55 will now be described in brief with reference to FIGS. 6 and 7. The shuttle 55 comprises a rotating hook bobbin case holder 57 prohibited from rotation and a rotating hook 58 rotated around the holder 57. The bobbin case holder 57 is adapted to hold a bobbin case 56 for accommodating a bobbin on which a looper thread 48 is wound at a plurality of turns. The rotating hook 58 has a beak 58*a* for seizing a needle thread 47 to form a needle thread loop 47*a*and a curved thread guide 59 formed integrally therewith to be opposed to the beak 58*a* outside the same. The bobbin case holder 57 has an annular rib or race 57*a* formed on an outer circumferential surface thereof. The annular rib 57*a* rotatably holds the bobbin case holder 57 when the rotating hook 58 assumes a preselected position.

The rotating hook 58 is rotated via the hook shaft 60 by the shuttle driving motor 53 in a predetermined direction in synchronism with the vertical movement of the sewing needle 22. As the result of rotation of the rotating hook 58 in the above-described manner, the needle thread 47 extending from an eye of the sewing needle 22 is captured by the beak 58*a* when a previously set timing of encounter with the needle is reached or when the main shaft 71 reaches a predetermined rotational position. With the captured needle thread 47 being moved along an oblique side of the beak 58*a*, the width of the engaged portion thereof is increased so that the captured needle thread 47 meets the annular rib 57*a* of the bobbin case holder 57, whereupon a needle thread loop 47*a* is formed. The needle thread loop 47*a* is engaged with a thread engagement portion 58*b* formed on the rotating hook 58 to be located in a space between the beak 58*a* and a thread guide portion 59*a*. The needle thread loop 47*a* is enlarged, engaged with a forward end of the annular rib 57*a*. When disengaged from the bobbin case holder 57, the needle thread loop 47*a* meets a bobbin thread 48 extending from the bobbin case 56.

Referring to FIG. 3, a rotary encoder 65 is provided in the vicinity of the second connecting member 63. The rotary encoder 65 comprises a disk 64 mounted on the second connecting member 63 and a photo interrupter 65*a* mounted on the mounting block 51. The photointerrupter 65*a* is designed to optically detect a plurality of slits formed in the disk 64, thereby delivering hook shaft rotation signals. More specifically, the photointerrupter 65*a* delivers, for example, fifty slit signals when the disk 64 is rotated one turn. A front end opening of the bed unit 10 is covered with a protective cover 66 pivoted to be opened and closed on a hinge mounted on the front end of the bed case 40.

A support structure for supporting the full-turn shuttle 55 will now be described in brief. A cylindrical bearing case 70 is provided directly inside the cylindrical portion of the mounting block 51 so as to be slidable forward and backward. A bearing 71 is provided in the bearing case 70 by press fitting. An eccentric pin 72 is mounted on a left-hand side wall of the mounting block 51. A distal end pin portion of the eccentric pin 72 is engaged with a longitudinal pin hole formed in a left-hand side wall of the bearing case 70. A setting screw 73 is detachably mounted on a right-hand side wall of the mounting block 51 for fixing the bearing case 70. The eccentric pin 72 is turned clockwise or counterclockwise while the setting screw 73 being loosened, whereby the bearing case 70 can be moved forward and backward by a slight distance, for example, 1 or 2 mm. Consequently, the position of the shuttle 55 can be adjusted forward and backward for adjustment of a needle gap.

Figure 5:
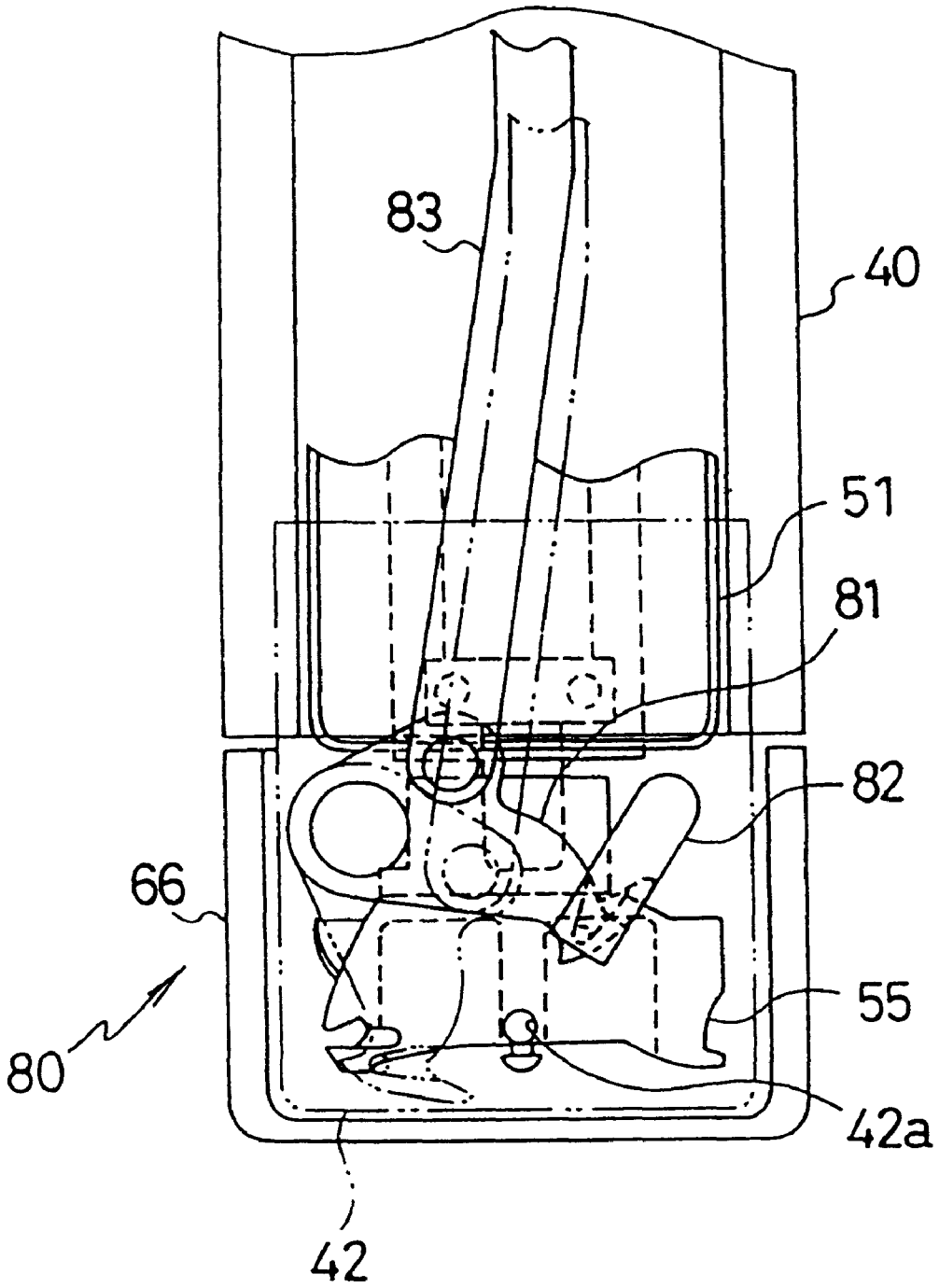
FIG. 5 is a partially enlarged plan view of a distal end of the bed unit.

Each of the bed units 10 to 12 is provided with a thread cutting mechanism 80 for cutting the needle thread 47 and the bobbin thread 48. Referring to FIG. 5, a movable blade 81 is pivotally mounted on the underside of the throat plate 42. The blade 81 is rockable between a standby position shown by solid line and a rotatively moved position shown by two-dot chain line in FIG. 5. A fixed blade 82 is mounted on the underside of the throat plate 42 to be opposed to an upper portion of the movable blade 81. The fixed blade 82 cuts the needle thread 47 and the bobbin thread 48 in cooperation with the movable blade 81. A thread cutting operation lever 83 rearwardly extends through the interior of the bed case 40. A thread cutting motor 85 is provided at the left-hand end of the base frame 1. Upon drive of the thread cutting motor 85, a sectorial rocking member 87 brought into mesh engagement with a driving gear 86 rocks to thereby move a thread cutting operation shaft 88 rightward and leftward, and a rotary plate 84 moves the thread cutting operation lever 83 forward and backward. Consequently, the movable blade 81 is rotated to simultaneously cut the needle thread 47 and the bobbin thread 48 in cooperation with the fixed blade 81.

Figure 8:
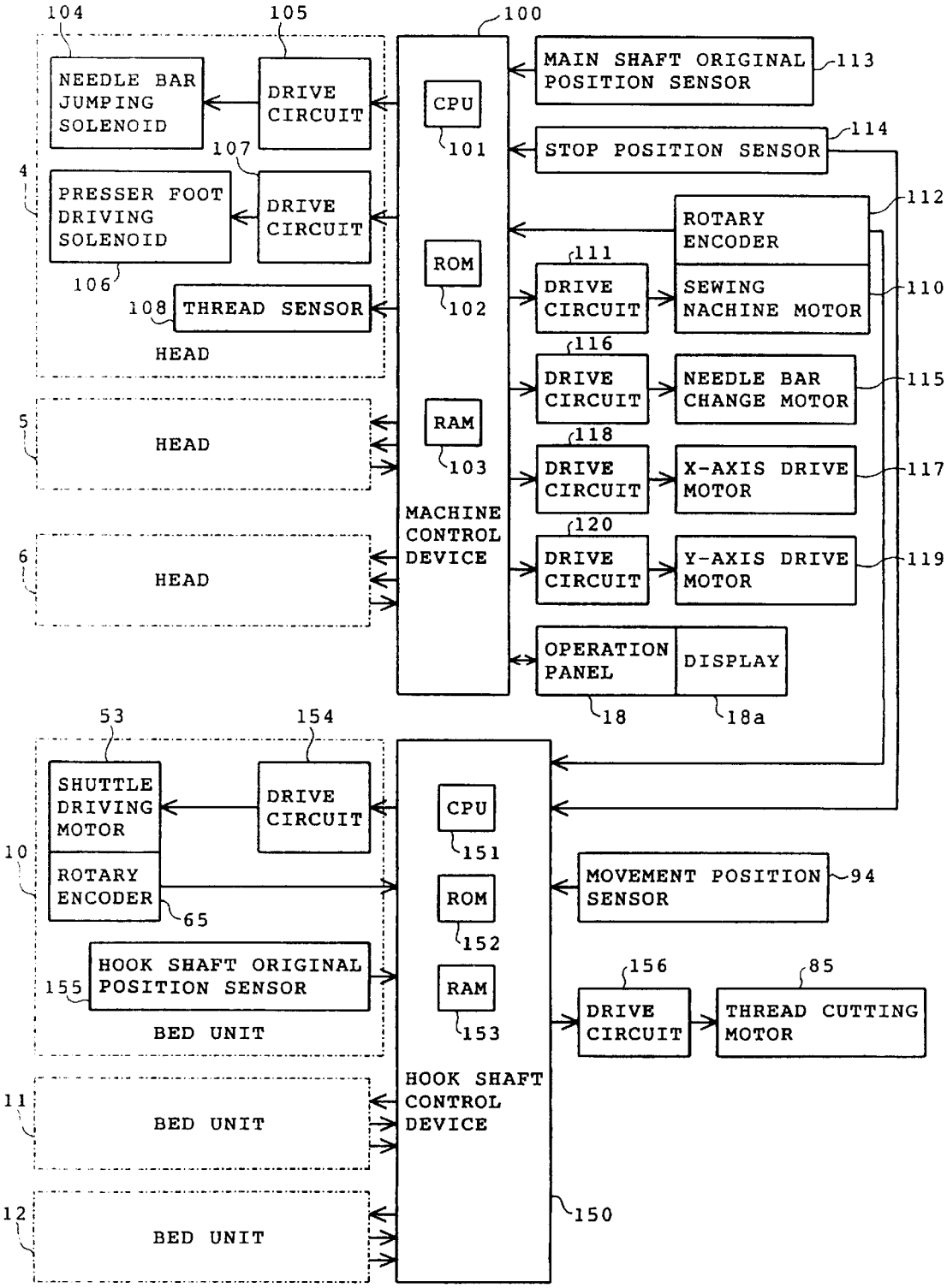
FIG. 8 is a block diagram showing a control system of the multi-head embroidery sewing machine.

An electrical arrangement or control system of the multihead embroidery sewing machine M will now be described with reference to FIG. 8. A machine control device 100 has a function of controlling an overall operation of the machine M except for control for the shuttle drive. The machine control device 100 comprises a microcomputer composed of a CPU 101, a ROM 102 and a RAM 103, and an input interface (not shown) and an output interface (not shown) each connected via data buses to the microcomputer. The ROM 102 stores sewing data corresponding to a plurality of embroidery patterns and a control program for controlling the sewing on the basis of the selected sewing data in a manner as will be described later.

With respect to each of the heads 4 to 6, the machine control device 100 is connected to a drive circuit 105 for driving a solenoid 104 of the needle bar jumping mechanism. The machine control device 100 is also connected to a drive circuit 107 for driving a presser foot driving solenoid 106 for forcing the presser foot to vertically move when the sewing is started and completed. The machine control device 100 is further connected to a thread sensor 108 for detecting presence or absence of a thread.

Furthermore, the machine control device 100 is connected to a drive circuit 111 for driving the machine motor 110, a drive circuit 116 for driving a needle bar change motor 115 moving the needle bar case 20, a drive circuit 118 for driving an X-axis drive motor 117, a drive circuit 120 for driving a Y-axis drive motor 119, and the operation panel 18. Additionally, the machine control device 110 is connected to a rotary encoder 112 different from the rotary encoder 65, a main shaft original position sensor 113, and a stop position sensor 114. The rotary encoder 112 comprises a disk mounted on the sewing machine motor 110 and a photointerrupter neither of which are shown. The photointerrupter of the rotary encoder 112 optically detects a plurality of slits formed in the disk, thereby delivering, for example, one thousand slit signals (main shaft rotation signals) when the disk is rotated one turn. The main shaft original position sensor 113 delivers a main shaft original position signal when the main shaft 17 assumes a position corresponding to its original position or initial position every time of one turn of the disk. The main shaft original position sensor 113 thus constitutes main shaft original position detecting means in the invention. The stop position sensor 114 detects a stop position of the needle bar when it is located over the needle.

A hook shaft control device 150 is connected to the machine control device 100. The hook shaft control device 150 has functions of controlling the shuttle driving motor 53, the thread cutting mechanism 80, etc. The hook shaft control device 150 comprises a microcomputer composed of a CPU 151, a ROM 152 and a RAM 153, and an input interface (not shown) and an output interface (not shown) each connected via data buses to the microcomputer. With respect to the bed unit 10, the hook shaft control device 150 is connected to a drive circuit 154 for driving the shuttle driving motor 53, the rotary encoder 65, and a hook shaft original position sensor 155. The hook shaft original position sensor 155 delivers one hook shaft original position signal every time the disk 64 of the rotary encoder 65 is turned one turn. The hook shaft original position sensor 155 constitutes hook shaft original position detecting means in the invention. The same circuits and sensor are connected to the hook shaft control device 150 with respect to each of the other bed units 11 and 12. Additionally, the hook shaft control device 150 is connected to a movement position sensor 94 for detecting a movement position of the movable blade 81 and a drive circuit 156 for driving the thread cutting motor 85.

Figure 9:
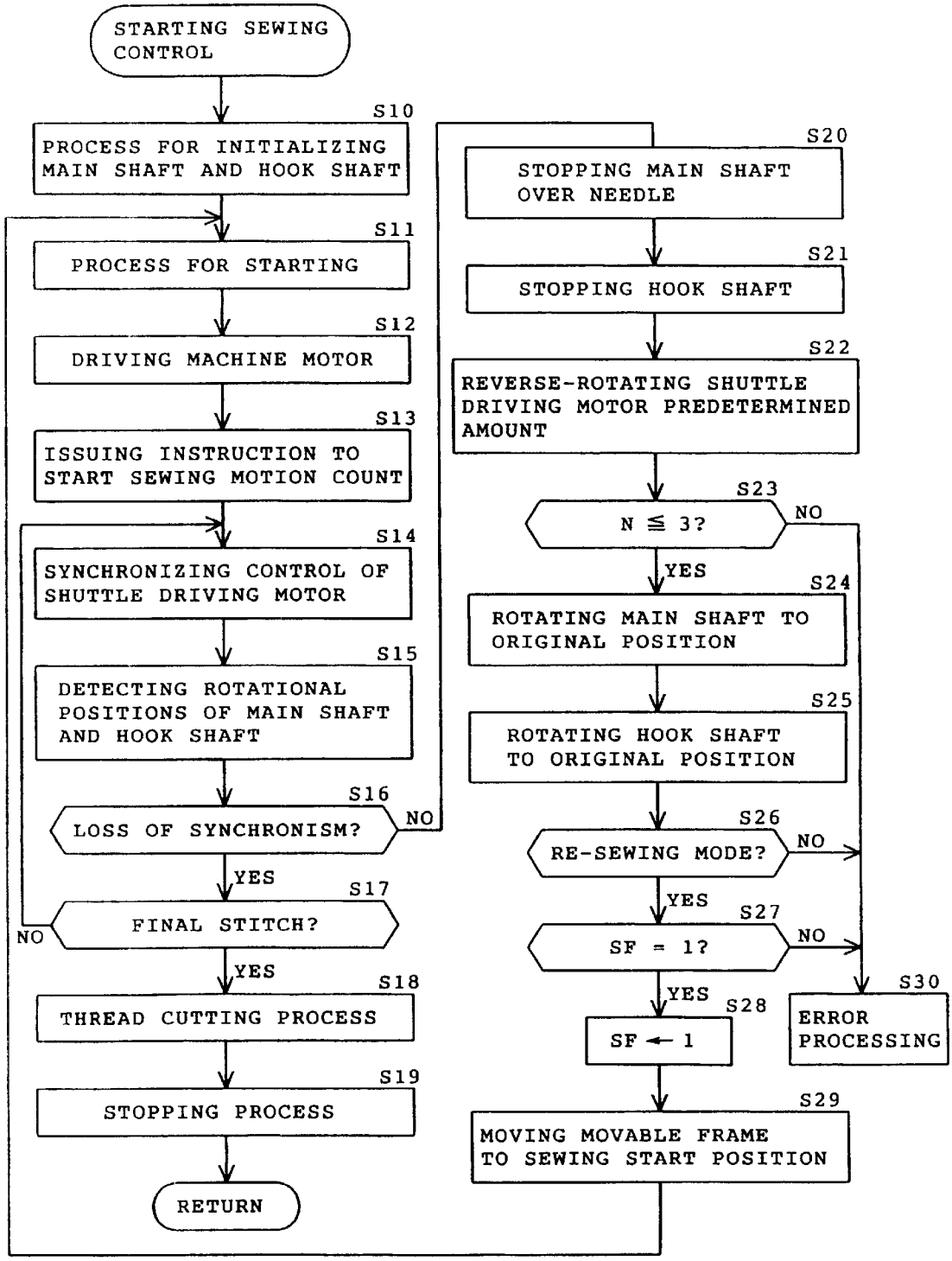
FIG. 9 is a flowchart explaining a sewing control routine.
Figure 10:
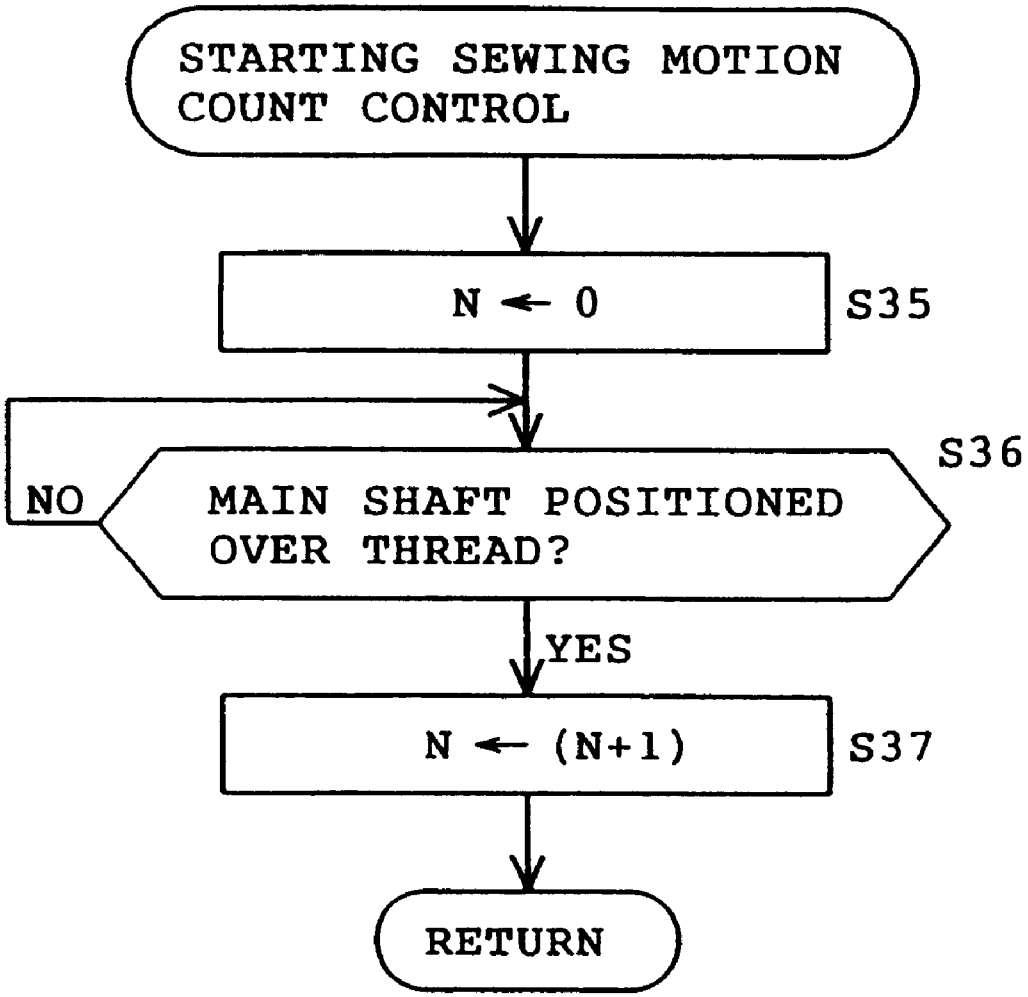
FIG. 10 is a flowchart explaining a sewing motion counting control routine.

The contents of the sewing control manners of the machine control device 100 and the hook shaft control device 150 of the multihead embroidery sewing machine M will now be described with reference to FIGS. 9 and 10 showing the contents of the sewing control and the contents of sewing motion counting control respectively. The machine control device 100 basically controls the sewing machine motor, whereas the hook shaft control device 150 basically controls the shuttle driving motor 53. Upon operation of the sewing start switch on the operation panel 18, the sewing control as shown in FIG. 9 is started. First, initializing processes for initializing the main shaft 17 and the hook shaft 60 respectively are executed at step S10. On the basis of the main shaft original position signal delivered by the main shaft original position sensor 113, the machine motor 110 is driven so that the main shaft 17 is rotated to assume an original position or initialization position where the sewing is started. With this, the shuttle driving motor 53 is driven on the basis of the hook shaft original position signal from the hook shaft original position sensor 155, so that the hook shaft 60 is rotated to assume an initialization position corresponding to the original position of the main shaft 17 or an original position of the hook shaft. A starting process is then executed at step S11. The selected sewing data is input and the movable frame 16 is moved to a sewing start position. Furthermore, the presser foot driving solenoid 106 is deenergized to lower the presser foot.

The machine motor 110 is then driven at step S12 and an instruction to start the sewing motion counting control is issued at step S13. In the sewing motion counting control, a sewing motion count N is first initialized (N=0) at step S35 as shown in FIG. 10. The sewing motion count N is incremented by one at step S37 every time the main shaft 17 is rotated one turn with the needle bar having reached its uppermost position (YES at step S36). The sewing motion counting control as shown in FIG. 10 constitutes sewing motion counting means in the invention. The above-described sewing motion counting control is executed in parallel with the sewing control as shown in FIG. 9.

Turning now to FIG. 9, a synchronizing control is executed on the basis of the slit signals from the rotary encoders 112 and 65 at step S14. In the synchronizing control, the shuttle driving motor 53 is driven in synchronism with rotation of the main shaft 17 or machine motor 110. For this purpose, the rotational position of the main shaft 17 is input, and the shuttle driving motor 53 is rotated by one step when a timing for rotating the hook shaft 60 by one step has been reached. The rotational positions of the main shaft 17 and the hook shaft 60 are detected at step S15. Steps S14 to S17 are repeatedly executed when these shafts 17 and 60 are in synchronism with each other (NO at step S16) and the sewing operation is not for a final stitch (NO at step S17). The above-described synchronizing control executed at step S14 by the machine control device 100 and the hook shaft control device 150 constitutes drive control means in the invention. Step S16 constitutes loss-of-synchronism detecting means in the invention.

Subsequently, a thread cutting process is executed at step S18 when an embroidery sewing operation in which a series of stitches are formed is completed (YES at step S17). The thread cutting motor 85 of the thread cutting mechanism 80 is driven so that the needle thread 47 and the bobbin thread 48 are cut as the result of reciprocal movement of the movable blade 81. A stopping process is then executed at step S19 to stop the machine motor 110 and the shuttle driving motor 53 and to drive the presser foot driving solenoid 106 so that the presser foot is lifted up.

Furthermore, the sewing motion counting control is stopped. The control sequence returns to the main routine (not shown) upon completion of the sewing control.

A leading end of the needle thread 47 is open when a sewing operation in which a series of stitches are formed or when the sewing is re-started after thread change during the sewing. Accordingly, the thread loop captured by the beak 58*a* of the rotating hook 58 is often loosened. In this case, as shown in FIG. 7, a thread jamming occurs when the loosened thread loop is caught between the annular rib 57*a* or race and the rotating hook 58. The thread jamming, when having occurred, stops the rotating hook 58. Then, the shuttle driving motor 53 causes loss of synchronism such that the phase of rotation of the hook shaft 60 lags behind the rotational position of the main shaft 17. Consequently, when the hook shaft 60 causes a loss of synchronism, for example, by several degrees (YES at step S16), the machine motor 110 is stopped so that the main shaft 17 is stopped at the position over the needle at step S20.

The shuttle driving motor 53 is then stopped so that an emergency stop of the hook shaft 60 is effected, at step S21. For the purpose of elimination of the thread jamming, the shuttle driving motor 53 is reverse-rotated by a predetermined amount, for example, about 30 to 50 degrees at step S22. The step S22 constitutes releasing means or hook shaft reverse rotation control means in the invention. The thread jamming tends to occur in initial stages of rotation of the machine motor 110 and the shuttle driving motor 53. However, the machine motor 110 and the shuttle driving motor 53 are rotated at relatively low speeds at initial stages of rotation of the motors respectively. Accordingly, the thread jamming, even when having occurred at the initial stages, can reliably be eliminated by the predetermined amount of reverse rotation of the shuttle driving motor 53. The sewing motion count N is input, an affirmative judgment is made (YES at step S23) when the input sewing motion count N is at or below 3 (at or below a predetermined number). A small number of stitches are formed when the sewing motion count N is at or below 3 at the occurrence of thread jamming. Accordingly, the re-sewing can be executed. The judgment at step S23 constitutes initialization instructing means in the invention. The re-sewing is executed in the following manner. First, as in the initializing processes at step S10, the main shaft 17 and the hook shaft 60 are rotated to assume the original positions or initialization positions at steps S24 and S25, respectively. The steps S24 and S25 constitute the initialization control means in this case. Whether a re-sewing mode for re-execution of sewing from the first stitch has been set is then judged at step S26. When the re-sewing mode has been set by the re-sewing mode setting switch on the operation panel 18 (YES at step S26), whether a re-sewing flag SF has been set is judged at step S27. A negative judgment is made (NO at step S27) when the re-sewing flag SF has not been set or when an initial sewing operation is executed after power supply to the sewing machine. Then, the re-sewing flag SF is set at "1"at step S28. The X-axis and Y-axis drive motors 117 and 119 are driven so that the movable frame 16 is moved to assume a position for start of the first stitch (step S29). The step S11 and subsequent steps are repeatedly executed so that the sewing is re-executed from the first stitch.

The loss of synchronism is re-detected with respect to the hook shaft 60 when the thread jamming has occurred again after the repeated execution of the step S11 and subsequent steps or when the previous thread jamming has not been eliminated. In this case, the affirmative judgment is made (YES at step S16). When the sewing motion count N is at or below 3 (YES at step S23) and the re-sewing mode has been set (YES at step S26), whether the re-sewing flag SF has been set is then judged at step S27. Since the re-sewing flag SF has been set at "1," the affirmative judgment is made (YES at step S27). Subsequently, an error processing is executed at step S30. In the error processing, an error message is displayed on the display 18*a* of the operation panel 18, or an alarming buzzer (not shown) is actuated. Furthermore, the re-sewing flag SF is reset at "0." The error processing is also executed at step S30 when the sewing motion count N is above 3 (NO at step S23) after detection of the loss of synchronism with respect to the hook shaft 60 (YES at step S16) or when the re-sewing mode has not been set (NO at step S26).

According to the above-described multihead embroidery sewing machine, both of the machine motor 110 and the shuttle driving motor 53 are stopped when a predetermined amount of displacement of the rotational position of the hook shaft 60 relative to the main shaft 17 has been reached after occurrence of thread jamming in the full-turn shuttle 55. Furthermore, the shuttle driving motor 53 is reverse-rotated by the predetermined amount so that the rotating hook 58 is rotated in the opposite direction. Consequently, the thread jamming can be eliminated automatically and readily. Accordingly, since a stopping time of the machine is shortened as much as possible and accordingly, a cycle time of the sewing is shortened, the sewing efficiency can be improved.

In the start of the sewing operation, the machine motor 110 and the shuttle driving motor 53 are controlled on the basis of the signals delivered from the main shaft original position sensor 113 and the hook shaft original position sensor 155 respectively, so that the main shaft 17 and the hook shaft 60 are positioned at the respective original positions. Accordingly, the main shaft 17 and the hook shaft 60 can automatically be initialized so as to be positioned so that the sewing can be started. Furthermore, the sewing motion of the needle is counted by the sewing motion control from the time of start of the continuously executed sewing, so that the thread jamming is detected. Upon detection of the thread jamming, the shuttle driving motor 53 is reverse-rotated. Additionally, the machine motor 110 and the shuttle driving motor 53 are initialized when the sewing motion count N is at or below 3. Consequently, the thread jamming occurring at the time of start of the sewing can be eliminated and the re-sewing can automatically be executed. Furthermore, upon detection of the thread jamming, the machine motor 110 and the shuttle driving motor 53 are initialized so as to assume the respective original positions. The re-sewing mode setting switch of the operation panel 18 is operable to set the re-sewing mode wherein the sewing is re-executed from the first stitch. Consequently, the re-sewing can be started promptly and automatically when the thread jamming has occurred and the re-sewing mode has been set.

In a modified form, the shuttle driving motor 53 is preferably reverse-rotated at lower speeds when the thread jamming has been detected. Furthermore, the reverse rotation and the normal rotation of the shuttle driving motor 53 may be executed alternately repeatedly several times so that the shuttle driving motor is reverse-rotated by a predetermined amount, for example, 30 to 50 degrees. In this case, the thread jamming can more reliably be eliminated.

In the foregoing embodiment, the error processing is executed with stop of execution of the re-sewing in the case where the thread jamming is detected twice even when the re-sewing mode has been set. In other words, the sewing is re-tried once in the foregoing embodiment. However, the sewing may be re-tried twice or more (several times, for example), instead.

Although the invention is applied to the multihead embroidery sewing machine in the foregoing embodiment, the invention may be applied to single head embroidery sewing machines. Furthermore, the invention may be applied to various types of sewing machines wherein various types of thread loop capturing shuttles such as a half-turn shuttle are driven by a shuttle driving motor independent of a sewing machine motor, for example, twin-needle automatic belt loop type sewing machines.

In the foregoing embodiment, the ROM 102 of the machine control device 100 and the ROM 152 of the hook shaft control device 150 store the programs for operating the multihead embroidery sewing machine or more specifically, for accomplishing the drive control means, the thread jamming detecting means, the loss-of-synchronism detecting means, the releasing means, and the hook shaft reverse rotation control means. For example, these programs may be stored in an external card ROM, instead. Furthermore, the machine control device 100 and the hook shaft control device 150 may be provided with EEPROMs so that the programs stored in the card ROM are transferred to the EEPROMs, respectively. Furthermore, the multihead embroidery sewing machine may be provided with a hard disk system and a floppy disk drive so that the programs are stored in the hard disk system. In this case, the programs are preferably stored in floppy disks, and the floppy disks are preferably attached to the floppy disk drive so that the programs are installed on the hard disk system of the embroidery sewing machine. Furthermore, the programs may be stored in a CD-ROM and the embroidery sewing machine may be provided with a CD-ROM drive so that the programs are installed through the CD-ROM on the embroidery sewing machine. Additionally, a recording medium for storing the programs should not be limited to the external card ROM, floppy disk and CD-ROM. Other recording media may be used for the purpose.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim:

1. A sewing machine comprising:

a sewing machine motor;

a main shaft driven by the sewing machine motor;

a sewing needle driven by the main shaft;

a shuttle for capturing a thread loop in cooperation with the sewing needle, the shuttle having a hook shaft;

a shuttle driving motor provided for driving the hook shaft of the shuttle independent of the sewing machine motor;

drive control means for controlling the sewing machine motor and the shuttle driving motor so that the shuttle is rotated in synchronism with the main shaft;

thread jamming detecting means for detecting a thread jamming in the shuttle; and releasing means controlling the shuttle driving motor for releasing the shuttle from the thread jamming when the thread jamming is detected by the thread jamming detecting means.

2. A sewing machine comprising:

a sewing machine motor;

a main shaft driven by the sewing machine motor;

a sewing needle driven by the main shaft;

a shuttle for capturing a thread loop in cooperation with the sewing needle, the shuttle having a hook shaft;

a shuttle driving motor provided for driving the hook shaft of the shuttle independent of the sewing machine motor;

drive control means for controlling the sewing machine motor and the shuttle driving motor so that the shuttle is rotated in synchronism with the main shaft;

loss-of-synchronism detecting means for detecting an increase to a predetermined amount in displacement of a rotational position of the hook shaft with respect to a rotational position of the main shaft; and hook shaft reverse rotation control means for controlling the shuttle driving motor so that the shuttle driving motor is reverse-rotated by a predetermined amount after interruption thereof when the predetermined amount of displacement has been detected by the loss-of-synchronism detecting means.

3. A sewing machine according to claim 1, further comprising:

main shaft original position detecting means for detecting a predetermined original position of the main shaft for start of the sewing, thereby delivering a first original position signal;

hook shaft original position detecting means for detecting an original position of the hook shaft corresponding to the original position of the main shaft, thereby delivering a second original position signal; and initialization control means for controlling the sewing machine motor and the shuttle driving motor so that the main shaft and the hook shaft are positioned at the original positions in case of start of a sewing operation on the basis of the first and second original position signals delivered by the main shaft and hook shaft original position detecting means respectively.

4. A sewing machine according to claim 2, further comprising:

main shaft original position detecting means for detecting a predetermined original position of the main shaft for start of the sewing, thereby delivering a first original position signal;

hook shaft original position detecting means for detecting an original position of the hook shaft corresponding to the original position of the main shaft, thereby delivering a second original position signal; and initialization control means for controlling the sewing machine motor and the shuttle driving motor so that the main shaft and the hook shaft are positioned at the original positions in case of start of a sewing operation on the basis of the first and second original position signals delivered by the main shaft and hook shaft original position detecting means respectively.

5. A sewing machine according to claim 3, further comprising:

sewing motion counting means for counting the number of sewing motions of the vertically moved sewing needle from start of a sewing operation in which a series of stitches are formed; and initialization instructing means for instructing the initialization control means to initialize the sewing machine motor and the shuttle driving motor in a case where the number of sewing motions counted by the sewing motion counting means is at or below a predetermined value when the shuttle driving motor has been driven by the releasing means so that the shuttle is released from the thread jamming.

6. A sewing machine according to claim 4, further comprising:

sewing motion counting means for counting the number of sewing motions of the sewing needle, which is vertically moved, from start of a sewing operation in which a series of stitches are formed; and initialization instructing means for instructing the initialization control means to initialize the sewing machine motor and the shuttle driving motor in a case where the number of sewing motions counted by the sewing motion counting means is at or below a predetermined value when the rotation of the shuttle driving motor has been reversed by the hook shaft reverse control means.

7. A sewing machine according to claim 5, further comprising mode setting means for setting a re-sewing mode in which the sewing is re-executed from a first stitch, when the initialization instructing means instructs the initialization control means to initialize the sewing machine motor and the shuttle driving motor.

8. A sewing machine according to claim 6, further comprising mode setting means for setting a re-sewing mode in which the sewing is re-executed from a first stitch, when the initialization instructing means instructs the initialization control means to initialize the sewing machine motor and the shuttle driving motor.

9. A sewing machine according to claim 8, further comprising first error processing means for executing an error processing when the predetermined amount of displacement of the rotational position of the hook shaft is detected by the loss-of-synchronism detecting means after re-execution of the sewing from the first stitch, even though the re-sewing mode has been set by the mode setting means.

10. A sewing machine according to claim 9, further comprising second error processing means for executing an error processing in a case where the initialization instructing means instructs the initialization control means to initialize the sewing machine motor and the shuttle driving motor when the re-sewing mode is not set by the mode setting means.

11. A storage medium for storing a program for operating a sewing machine comprising a sewing machine motor, a main shaft driven by the sewing machine motor, a sewing needle driven by the main shaft, a shuttle for capturing a thread loop in cooperation with the sewing needle, the shuttle having a hook shaft, and a shuttle driving motor provided for driving the hook shaft independent of the sewing machine motor, the program accomplishing the functions of:

drive control means for controlling the sewing machine motor and the shuttle driving motor so that the shuttle is rotated in synchronism with the main shaft;

thread jamming detecting means for detecting a thread jamming in the shuttle; and releasing means controlling the shuttle driving motor for releasing the shuttle from the thread jamming when the thread jamming is detected by the thread jamming detecting means.

12. A storage medium according to claim 11, wherein the thread jamming detecting means comprises loss-of-synchronism detecting means for detecting an increase to a predetermined amount in displacement of a rotational position of the hook shaft with respect to a rotational position of the main shaft, and the releasing means comprises hook shaft reverse rotation control means for controlling the shuttle driving motor so that the shuttle driving motor is reverse-rotated by a predetermined amount after interruption thereof when the predetermined amount of displacement has been detected by the loss-of-synchronism detecting means.

13. A storage medium according to claim 12, wherein the program further accomplishes the function of initialization control means for controlling the sewing machine motor and the shuttle driving motor so that the main shaft and the hook shaft are positioned at the original positions in case of start of a sewing operation on the basis of the first and second original position signals delivered by the main shaft and hook shaft original position detecting means respectively.

14. A storage medium according to claim 13, wherein the program further accomplishes the functions of:

sewing motion counting means for counting the number of sewing motions of the vertically moved sewing needle from start of a sewing operation in which a series of stitches are formed; and initialization instructing means for instructing the initialization control means to initialize the sewing machine motor and the shuttle driving motor in a case where the number of sewing motions counted by the sewing motion counting means is at or below a predetermined value when the shuttle driving motor has been driven by the releasing means so that the shuttle is released from the thread jamming.

* * * * *